US006161290A

United States Patent [19]

Takamasa

[11] Patent Number: 6,161,290

[45] Date of Patent: Dec. 19, 2000

[54] UTILITY KNIFE

[75] Inventor: Mitsuhiro Takamasa, Kyoto, Japan

[73] Assignee: Kyoto Measuring Instruments Corp., Kyoto, Japan

[21] Appl. No.: 08/998,558

[22] Filed: Dec. 29, 1997

[30] Foreign Application Priority Data

Dec. 18, 1997 [JP] Japan ..... 9-348804

[51] Int. Cl.[7] ..... B26B 1/00

[52] U.S. Cl. ..... 30/162; 30/320; 30/335

[58] Field of Search ..... 30/160, 161, 162, 30/320, 335, 294

[56] References Cited

U.S. PATENT DOCUMENTS

| | | | |
|---|---|---|---|
| 3,863,339 | 2/1975 | Reaney et al. | 30/162 |
| 4,028,758 | 6/1977 | O'Conner | 30/162 X |
| 4,621,425 | 11/1986 | Stoutenberg | 30/162 |
| 4,835,865 | 6/1989 | Knoop | 30/162 |
| 4,910,821 | 3/1990 | Kieferle | 7/158 |
| 5,012,581 | 5/1991 | Fletcher et al. | 30/162 |
| 5,203,085 | 4/1993 | Berns | 30/162 X |
| 5,299,355 | 4/1994 | Boda et al. . | |
| 5,426,855 | 6/1995 | Keklak et al. | 30/162 |
| 5,495,670 | 3/1996 | Quinn | 30/162 |
| 5,581,890 | 12/1996 | Schmidt | 30/162 |
| 5,617,635 | 4/1997 | Berns | 30/162 |
| 5,813,121 | 9/1998 | Gringer | 30/162 |
| 5,870,828 | 2/1999 | Polites | 30/162 |

*Primary Examiner*—M. Rachuba
*Attorney, Agent, or Firm*—Jordan and Hamburg LLP

[57] ABSTRACT

A utility knife having a holder body for supporting a blade slidably between a protruded position and a returned position, the utility knife comprising a spring means to be operated against a slider supporting the blade, a slider for manually moving said blade to a protruded position, a lock means for locking the slide movement of said slider at said protruded position resisting against the spring force of the spring means, and a means for releasing the lock of said lock means, wherein upon use, the blade temporarily fixed to the slider will be protruded from the holder by manually sliding said slider, and the blade could be locked at the end position of the slide. When storing the blade, the lock could be released by pressing on the lock release button, which allows the slider to be pulled back by the spring, and along with this movement, the blade could be stored automatically inside the holder body.

19 Claims, 4 Drawing Sheets

UTILITY KNIFE

TECHNICAL FIELD OF THE INVENTION

The present invention relates to a utility knife, and more particularly, to a utility knife with a structure for enabling the blade of the utility knife to be fixed at the state where it is protruded from the holder body of the utility knife, and also to be stored inside the holder body by an easy operation.

BACKGROUND OF THE INVENTION

From the past, utility knifes with fixed protruded blades were popular, but recently, improved utility knives with a slide structure where a slider with a blade fixed thereto could be manually slided in back and forth directions by hand, and further could be stored inside the holder body are well known.

In addition to that, products with consideration for safety characteristics exist wherein the slider holding the blade could be slided manually, but when after use, the slider, and thereby the blade, is pulled back inside the holder body.

This type of utility knife is disclosed for example in Japanese Laid-Open Utility Model Publication No. 56-111970 which is a knife where the blade is protruded from the holder body by holding the body by the hand and sliding the slider body against the elastic body by a thumb, and when the cutting operation is finished, the user releases the thumb and the slider is pulled back by the elastic body, storing the blade back inside the holder body. An improved example of such type of utility knife is disclosed in Japanese Laid-Open Patent Publication No. 6-315577 wherein the slider body comprises a main slider and a sub slider, the main slider adjusts briefly the amount of blade to be protruded from the holder body, and the sub slider adjusts in detail said amount of blade protrusion, enabling an exact adjustment of the protrusion of the blade.

However, these products were not very convenient in that the blades could not be fixed in a protruded state from the holder of the knife, and the user had to hold the slider during the whole time of use to keep the protruded state of the blade.

With consideration to the above problem, there is an invention disclosed in Japanese Laid-Open Patent Publication No. 5-212161 wherein the blade could be stopped at the protruded state from the knife body, and when the knife is not used, the blade of the knife could be returned to the protective position by use of a spring.

This invention, however, has safety problems in that the matching teeth mounted on the extending portion of the knife holding body for exchangeably holding the knife and the concave matching portion of the stopper nail supported rotatably on the gripping body of the knife is held together in a stop position by the spring force enforcing the knife holding body in the returning direction, and this stop is released by the centrifugal force operated to the stopper nails. Therefore, the operation of the knife was not stable, and a swinging movement of the knife itself to occur centrifugal force was dangerous.

SUMMARY OF THE INVENTION

The present invention aims at solving the above-mentioned problems wherein the first object of the invention is to provide a utility knife whose blade could be fixed at a using state where the blade is protruded from the knife holder body.

The second object of the present invention is to provide a utility knife whose blade fixed at a using state with the blade protruded from the knife holder body could be stored inside the knife holder body automatically by a simple and certain operation at the time of storage.

A utility knife of the present invention having a holder body for supporting a blade slidably between a protruded position and a returned position, the utility knife comprises:

a means for sliding the blade toward a protruding direction;

a means for forcing the blade toward a returning direction; and a means for locking the slide movement of the blade at said protruded position resisting against the means for forcing the blade toward the returning direction.

A utility knife of the present invention having a holder body for supporting a blade slidably between a protruded position and a returned position, comprises:

a means for sliding the blade toward a protruding direction;

a means for forcing the blade toward a returning direction;

a means for locking the slide movement of the blade at said protruded position resisting against the means for forcing the blade toward the returning direction; and a means for releasing said lock.

In the utility knife of the present invention, said means for sliding the blade toward a protruding direction is a slider on which said blade is supported.

In the utility knife of the present invention, said slider comprises a protrusion protruded outwardly through a groove formed on said holder body for placing a finger of a user.

In the utility knife of the present invention, said means for forcing the blade toward a returning direction is a spring means connected to said slider.

A utility knife of the present invention having a holder body for supporting a blade slidably between a protruded position and a returned position, comprises:

a slider for supporting said blade and for manually moving said blade to a protruded position;

a spring means for forcing said slider toward a returning direction; and a lock means for locking the slide movement of said slider at said protruded position resisting against the spring force of the spring means.

A utility knife of the present invention having a holder body for supporting a blade slidably between a protruded position and a returned position, comprises:

a slider for supporting said blade and for manually moving said blade to a protruded position;

a spring means for forcing said slider toward a returning direction;

a lock means for locking the slide movement of said slider at said protruded position resisting against the spring force of the spring means; and a means for releasing the lock of said lock means.

In the utility knife of the present invention, said lock means for locking the slide movement is a stopper in the shape of a leaf-spring mounted on the slider, and a step portion formed on a sliding wall of said slider of the utility knife.

In the utility knife of the present invention, said means for releasing the lock of said lock means is a means for releasing a fit connection of a stopper in the shape of a leaf-spring mounted on the slider and a step portion formed on a sliding wall of said slider of the utility knife.

In the utility knife of the present invention, said means for releasing a fit connection is a lock release button comprising a head portion and an elastic strip member extending from said head portion and being fixed to an inner wall of said utility knife.

By the above structure, the present invention solved the inconvenience of the prior utility knife wherein the user must hold the slider with the finger to keep the blade protruding from the knife holder body, and the present invention enabled to store the blade inside the knife holder automatically with the use of a spring simply by pressing on the lock release button. Therefore, a safe and useful utility knife could be provided.

PREFERRED EMBODIMENT OF THE INVENTION

Figure 4:
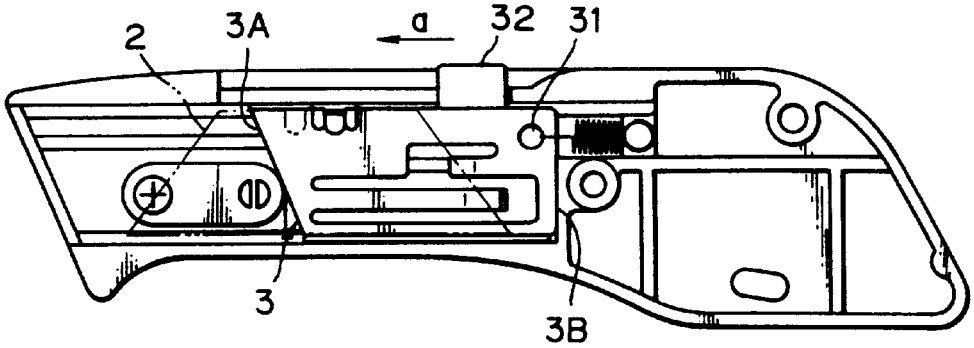
FIG. 4 is a cross-sectional view taken along line A–A' of FIG. 2 showing the state where the blade is stored inside the holder body.

FIG. 4 is a cross-sectional view of a utility knife of the present invention, wherein upon use, a blade 2 temporarily fixed to a slider 3 could be protruded from a holder by sliding said slider 3 manually, enabling the blade to be fixed by locking the slider at the end portion. Further, when storing said blade 2, a lock release button 4 (refer to FIG. 9) could be pressed to release the lock portion of the holder, thereby pulling the slider back by a spring, and storing the blade inside a holder body 1 automatically.

Figure 6:
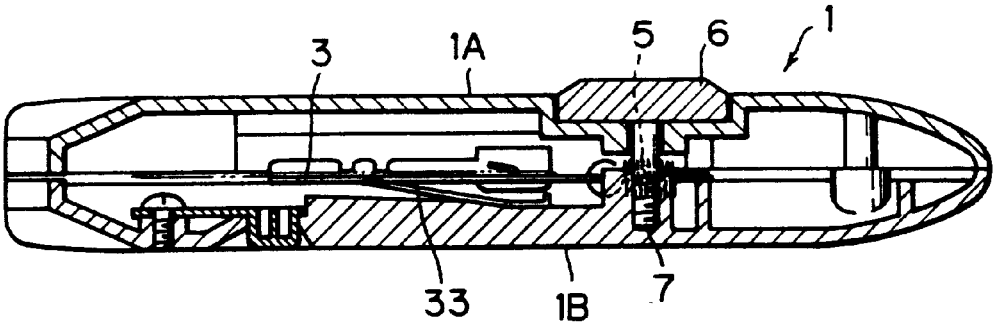
FIG. 6 is a cross-sectional view taken along line B–B' of FIG. 1 showing the state where the blade is stored inside the holder body.
Figure 8:
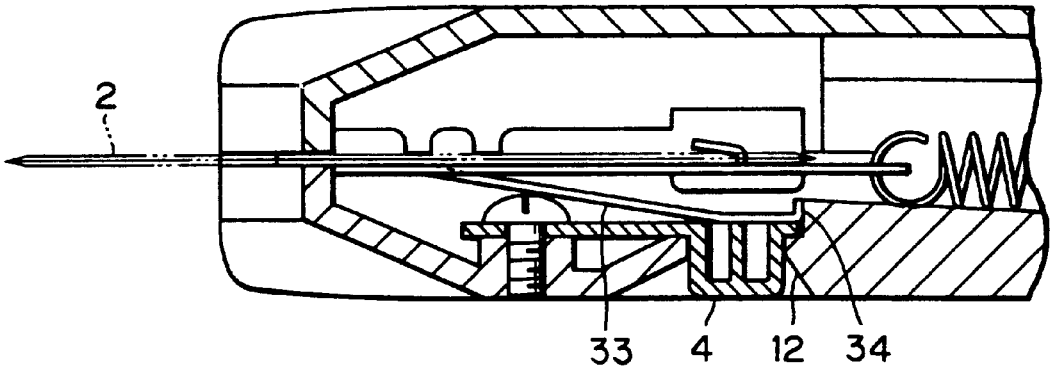
FIG. 8 is an enlarged view of the main portion of FIG. 7 showing the structure for fixing the blade at the protruded state.

As is shown in FIG. 6, a portion of the slider is formed as a leaf spring member 33 which works as a stopper. When the slider 3 is moved toward the forward direction of the knife holder body 1 and the front end portion of said leaf spring member passes a step portion of the holder body 1, that is, when the blade reaches a protruding position at the end of the slide, and when the finger is released from the slider, the slider will be pulled back by the spring 5, but the end portion of the leaf spring member 3 is caught at the step portion, thereby providing a lock as shown in FIG. 8.

Figure 9:
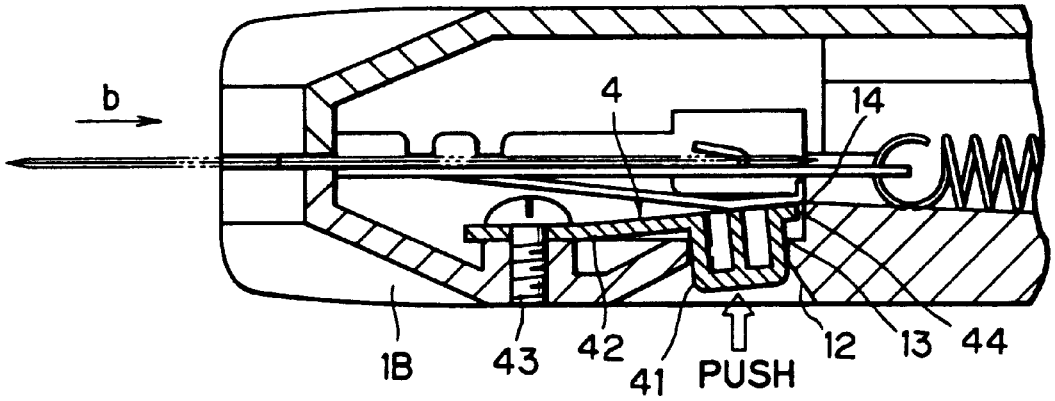
FIG. 9 is an enlarged view as in FIG. 8 showing the structure for releasing the fixed state of the blade.

In order to release the lock by pressing the lock release button 4 as shown in FIG. 9, the end portion with the leaf spring member of the slider 3 will be pressed and released from the step portion 14 of the holder.

The slider 3 and the holder body 1 is connected by a spring 5, and when the lock is released, the slider 3 will be pulled back inside the knife holder body 1 by the spring 5, and the blade 2 temporarily fixed to the slider will be stored inside the holder body 1.

Holder Body

Figure 1:
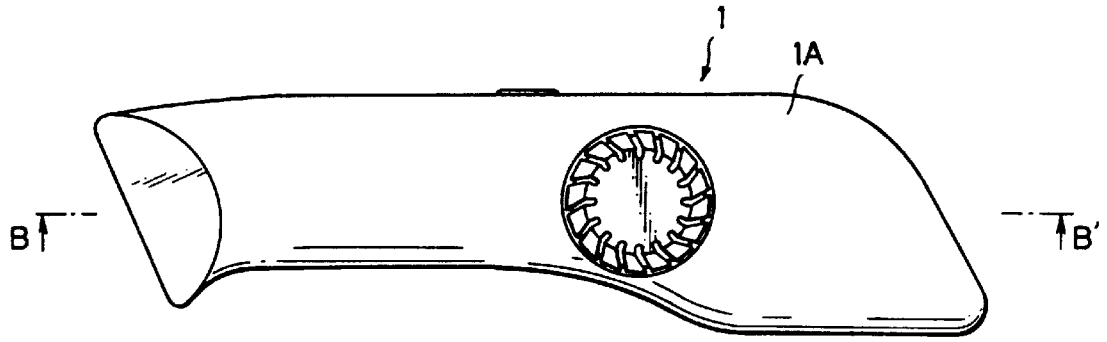
FIG. 1 is a plain view of the utility knife holder body of the present invention.
Figure 2:
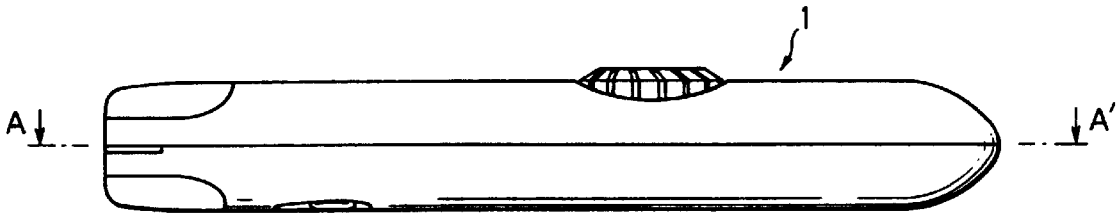
FIG. 2 is a front view of the utility knife holder of the present invention.
Figure 3:
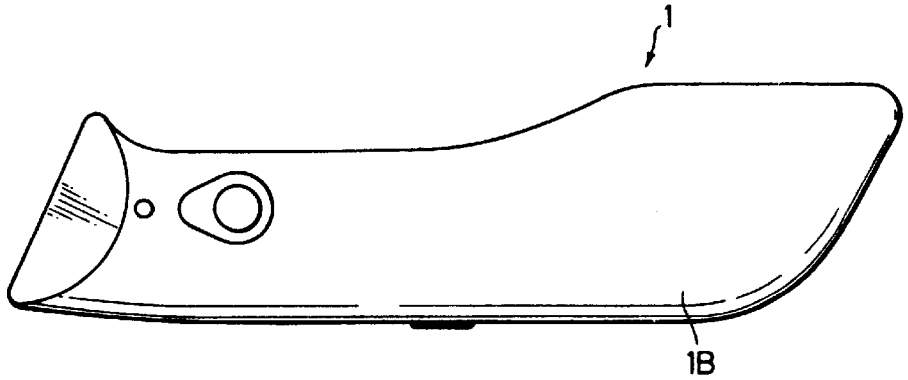
FIG. 3 is a bottom view of the utility knife holder body of the present invention.

The holder body 1 of the utility knife of the present invention comprises a left side member 1A shown in FIG. 1 and a right side member 1B shown in FIG. 3, and the left and right side members 1A and 1B are fixed together for example by a screw 6 and a screw hole 7 shown in FIG. 6, at a state where the structure for sliding the blade 2 in and out of the holder body and the structure for locking and releasing the lock, such as a blade 2 of the utility knife, a slider 3 supporting the blade 2 slidably inside the holder body, a lock release button 4 for releasing the lock of the slider, and the like, is stored inside the body. FIG. 2 shows the state where the both side members are matched and fixed together.

[Blade]

Figure 5:
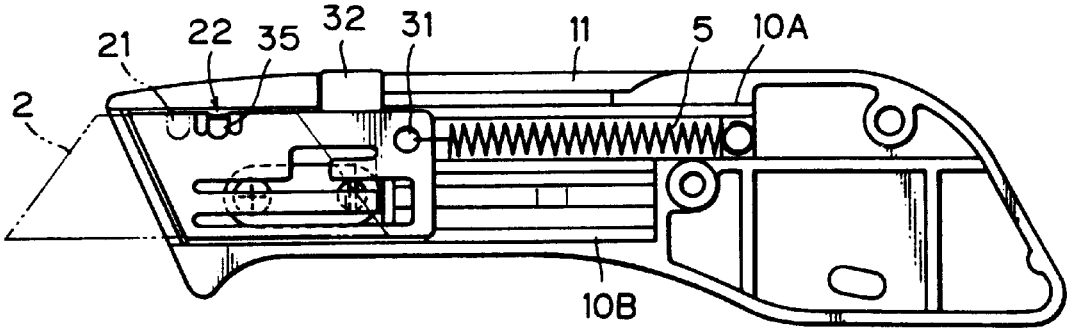
FIG. 5 is a cross-sectional view as in FIG. 4 showing the state where the blade is protruded from the holder body.

The blade 2 has a plane trapezoid shape as is shown in FIG. 5, with two cut-off portions 21 formed on the portion corresponding to the upper portion of the trapezoid. The cut-off portion 21 is fit to a protrusion 35 mounted on the slider, constituting a temporary fixing portion 22. In the drawing, the cut-off portion 21 close to the latter end of said blade is fit to the protrusion 35 of the slider 3 and temporarily fixed to the slider 3.

[Slider]

The slider 3 has a shape as is shown in FIG. 4 for example, with a front end portion inclined to the opposite direction as the inclined portion of the blade 2 and an opposite end portion forming a part of a square shape, and at the position close to an end portion 3B which is opposite to the front end portion 3A of the slider 3 and further at the upper portion of the drawing in FIG. 5, a spring mounting hole 31 for receiving an end portion of a spring 5 of a coil spring and the like which provides a returning force to the slider and whose other end is held at the holder body 1 is formed. Further, as is shown in FIG. 5, the longitudinal direction of the upper end portion of the slider 3, that is, the position close to said opposite end portion rather than at the center of the slider is formed a protrusion 32 which works as an operational finger grip. This protrusion 32 protrudes outwardly from the holder body 1 through a long groove 11 formed on the utility knife holder body 1.

Figure 7:
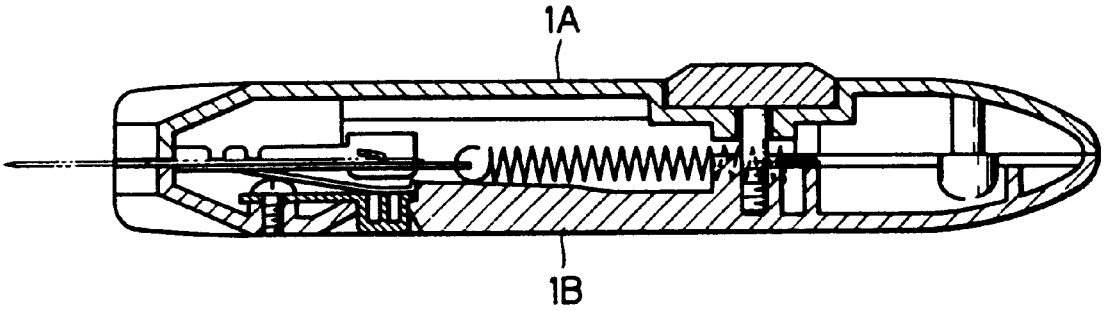
FIG. 7 is a cross-sectional view as in FIG. 6 showing the state where the blade is protruded from the holder body.

As is clear from FIGS. 8 and 9 which is a partial enlarged view of FIG. 7 showing the protruded state of the blade from the holder body, a leaf spring member is mounted at the front portion of the slider in the drawing whose free end is formed so as to separate farther away from the back surface of the slider than any other member toward the back portion, constituting a stopper 33 for locking purpose. At the free end of said stopper 33, a stopper portion 34 bent toward the upper direction is formed which prevents the return of the slider 3 to the latter direction by said spring 5 when it is matched to the step portion 14 formed on the wall of the right side member 1B of the utility knife body.

Further, the slider 3 is slidably stored in between an upper slide groove 10A and a lower slide groove 10B of the holder body 1, enabling the front end of the blade 2 fixed on the slider 3 to be moved in and out of the holder body 1.

[Lock Release Button]

As is most clearly shown in FIGS. 8 and 9, the right side portion 1B of the utility knife body is provided with a hole 12 allowing the slide movement of the lock release button 2 to be operated therethrough, and said hole 12 is formed to have a mortar shape at the portion close to the surface of said holder, that is, a shape with a gradually enlarged diameter toward the outside.

A step portion 13 for fitting the collar 44 formed on the head portion of the lock release button is formed on the wall of said hole 12, and the wall of said step portion 13 is opened directly to the interior of said holder body 1, and the edge of said opening becomes a step portion 14 for holding the stopper portion 34 of said slider 3.

The lock release button 4 comprises ahead portion 41 formed in a cylindrical shape, and an elastic stripe member 42 extending from said head portion 41. The lock release button 4 is fixed to said right side member 1B of the body by an appropriate fixing means 43 of a screw and the like at the end of the stripe member 42 in the position opposite the head portion 41. The upper surface of the head portion 41 of the lock release button 4 is formed to be positioned on the same surface as the body surface of the knife holder in order to prevent accidental operation.

[Operation]

Next, the operation of the utility knife of the present invention will be explained.

[When using the knife]

When using the utility knife, the user puts his/her finger on the protrusion 32 protruding from the sliding groove 11 of the utility knife holder body 1, and pushes it towards the direction shown by arrow a in FIG. 4 or the front portion of the knife resisting against the spring force of the coil spring 5. By this movement, the slider 3 slides toward the front portion of the knife along the sliding groove 10A and 10B, and the blade 2 fixed onto the slider 3 by a temporarily fixing portion 22 will move toward the front portion as well.

When the slider 3 slides inside the holder body 1 of the utility knife, the stopper 33 in the shape of a leaf-spring fixed to the slider 3 will also slide in a bent state with its front end portion (stopper portion) 34 pressing against the inner wall surface of said right side member 1B. And when the slider 3 reaches the position corresponding to the protrusion end of the blade 2, that is, the position of the hole 12, said contacting end portion 34 of said stopper 33, being released of its elastic force, will be inserted to the hole 12 formed on the inner wall surface of said right side member 1B, and presses against the back surface of the head portion 41 of the lock release button. By this movement, the lock release button 4 will be pressed toward the side direction of the knife holder (the lower direction of FIG. 7), but since the collar 44 of the head portion 41 of said lock release button 4 is matched to the step portion 13 of the hole 12, any further movement of the contact end portion 34 of said stopper 33 will be prevented.

When the user releases his/her finger from said protrusion 32 at this state, the stopper portion 34 formed on the free end of the stopper 33 will fit to the step portion 14 of the hole 12 formed on the inner wall surface of the right side member 1B thereby preventing the return movement of the slider 3 by the spring 5, and the blade will be locked at that position.

By the operation described above, the user could use the knife with the blade 2 of the utility knife being at the position protruding from the holder body 1 without being concerned about the blade returning into the knife.

[After using the knife]

Next, the operation for storing the blade of the knife into the utility knife holder body after using the knife is explained.

The user presses the head portion 41 of the lock release button 4 from the side of the knife holder body. Then, the stripe member 42 in the shape of a leaf-spring state extending from the head portion 41 of the lock release button 4 and the stopper 33 in the shape of a leaf-spring state of the slider 3 connected to the head portion 41 will bend, and the stopper portion 34 of the stopper 33 will be pushed out from the inner wall step portion 11 of the right side member 1B. When this happens, nothing will prevent the slider 3 from returning into the holder, so the slider 3, by the spring force of the spring 5, will be pulled back toward the back portion of the knife holder as is shown by arrow b of FIG. 9, and along with the slider, the blade 2 will also be stored again inside the utility knife body.

What is claimed is:

1. A utility knife having a holder body for supporting a blade slidably between a protruded position extending out of the holder body and a returned position retracted within the holder body at a position where a cutting edge of the blade is not exposed, the utility knife comprising:

a slider means for sliding the blade in a protruding direction to the protruded position;

a means for biasing the blade in a returning direction to return the blade from the protruded position to the returned position;

a lock mechanism for locking slide movement of the blade at said protruded position to resist against the means for biasing the blade in the returning direction, said lock mechanism for locking including:

a leaf-spring mounted on the slider means and having an end portion biased toward an inner wall of said holder body; and a step portion formed on said inner wall of said holder body for engaging said end portion of said leaf-spring when said end portion passes over said step portion during sliding of the blade in the protruding direction such that movement of said leaf-spring and said slider means in the returning direction is prevented; and a means for releasing said lock mechanism to permit return of the blade to the returned position by action of said means for biasing, said means for releasing including a release button movably disposed in said holder body permitting displacement by a user to a position engaging and displacing said leaf-spring to remove said end portion of said leaf-spring from engagement with said step portion.

2. The utility knife of claim 1, wherein said release button is movably disposed such that movement in directions other than substantially orthogonal to said protruding direction and said returning direction is restricted.

3. The utility knife of claim 1 wherein the step portion has a step surface facing in the protruding direction which is engaged by said end portion of said leaf-spring to lock the slider means in position preventing said means for biasing from returning said slider means and said blade to the returned position.

4. The utility knife of claim 1, wherein said means for sliding the blade in said protruding direction is a slider on which said blade is supported.

5. The utility knife of claim 4, wherein said holder body has a groove slot extending in a sliding direction of said slider and said slider has a protrusion protruded outwardly through said groove slot for actuation of said slider by a finger of a user to extend said blade to said protruded position from said returned position.

6. The utility knife of claim 1, wherein said means for releasing said lock mechanism includes:

an elastic strip member connecting said release button to said inner wall in a biased state permitting said release button to engage said leaf-spring; and an aperture in said inner wall permitting user deflection of said release button into said leaf-spring member to displace said end portion of said leaf-spring member from said engagement with said step portion and thereby permit said means for biasing the blade to return said blade to the returned position.

7. The utility knife of claim 6 wherein said release button has a head surface upon which a user presses to release said lock mechanism and said head surface is normally biased at a position even with an outside body surface of said holder body.

8. A utility knife having a holder body for supporting a blade slidably between a protruded position extending out of the holder body and a returned position retracted within the holder body at a position where a cutting edge of the blade is not exposed, the utility knife comprising:

a slider for supporting said blade and for manually moving said blade to said protruded position;

a spring means for biasing said slider in a returning direction to return the blade from the protruded position to the returned position;

a lock mechanism for locking slide movement of said slider at said protruded position to resist against spring force of the spring means, said lock mechanism including:

a leaf-spring mounted on the slider and having an end portion biased toward an inner wall of said holder body; and a step portion formed on said inner wall of said holder body for engaging said end portion of said leaf-spring when said end portion passes over said step portion during sliding of the blade in the protruding direction such that movement of said leaf-spring and said slider in the returning direction is prevented; and a means for releasing locking action of said lock mechanism on said slide movement of said slider, said means for releasing including a release button movably disposed in said holder body permitting displacement by a user to a position engaging and displacing said leaf-spring to remove said end portion of said leaf-spring from engagement with said step portion.

9. The utility knife of claim 8, wherein said release button is movably disposed such that movement in directions other than substantially orthogonal to said protruding direction and said returning direction is restricted.

10. The utility knife of claim 8 wherein the step portion has a step surface facing in the protruding direction which is engaged by said end portion of said leaf-spring to lock the slider in position preventing said spring means from returning said slider and said blade to the returned position.

11. The utility knife of claim 8, wherein said blade is supported on said slider.

12. The utility knife of claim 11, wherein said holder body has a groove slot extending in a sliding direction of said slider and said slider has a protrusion protruded outwardly through said groove slot for actuation of said slider by a finger of a user to extend said blade to said protruded position from said returned position.

13. The utility knife of claim 8, wherein said means for releasing said lock mechanism includes:

an elastic strip member connecting said release button to said inner wall in a biased state permitting said release button to engage said leaf-spring; and an aperture in said inner wall permitting user deflection of said release button into said leaf-spring member to displace said end portion of said leaf-spring member from said engagement with said step portion and thereby permit said spring means to return said blade to the returned position.

14. The utility knife of claim 13 wherein said release button has a head surface upon which a user presses to release said lock mechanism and said head surface is normally biased at a position even with an outside body surface of said holder body.

15. A utility knife having a holder body for supporting a blade slidably between a protruded position extending out of the holder body and a returned position retracted within the holder body at a position where a cutting edge of the blade is not exposed, the utility knife comprising:

a slide means for sliding the blade in a protruding direction to the protruded position;

a means for biasing the blade in a returning direction to return the blade from the protruded position to the returned position; and a lock mechanism for locking slide movement of the blade at said protruded position to resist against the means for biasing the blade in the returning direction, said lock mechanism for locking including:

a leaf-spring mounted on the slider means and having an end portion biased toward an inner wall of said holder body; and a step portion formed on said inner wall of said holder body for engaging said end portion of said leaf-spring when said end portion passes over said step portion during sliding of the blade in the protruding direction such that movement of said leaf-spring and said slider means in the returning direction is prevented; and a means for releasing said lock mechanism to permit return of the blade to the returned position by action of said means for biasing, said means for releasing being a means for displacing said leaf-spring to remove said end portion of said leaf-spring from engagement with said step portion.

16. The utility knife of claim 15, wherein said means for displacing said leaf-spring is a lock release button mechanism including:

a button portion;

an elastic strip member connecting said button portion to said inner wall in a biased state permitting said button portion to engage said leaf-spring; and an aperture in said inner wall permitting user deflection of said button portion into said leaf-spring member to displace said end portion of said leaf-spring member from said engagement with said step portion and thereby permit said means for biasing the blade to return said blade to the returned position.

17. The utility knife of claim 15, wherein said slide means for sliding the blade in said protruding direction is a slider on which said blade is supported.

18. The utility knife of claim 17, wherein said holder body has a groove slot extending in a sliding direction of said slider and said slider has a protrusion protruded outwardly through said groove slot for actuation of said slider by a finger of a user to extend said blade to said protruded position from said returned position.

19. The utility knife of claim 1 or claim 8 wherein said release button has a head surface upon which a user presses to release said lock mechanism and said head surface is normally disposed at a position even with an outside body surface of said holder body.

* * * * *